US010991338B2

(12) United States Patent
Kurikko

(10) Patent No.: US 10,991,338 B2
(45) Date of Patent: Apr. 27, 2021

(54) APPARATUS, DISPLAY MODULE AND METHOD FOR ADAPTIVE BLANK FRAME INSERTION

(75) Inventor: Jarmo Juhani Kurikko, Espoo (FI)

(73) Assignee: Nokia Technologies Oy, Espoo (FI)

( * ) Notice: Subject to any disclaimer, the term of this patent is extended or adjusted under 35 U.S.C. 154(b) by 580 days.

(21) Appl. No.: 13/636,781

(22) PCT Filed: Mar. 25, 2010

(86) PCT No.: PCT/IB2010/051320

§ 371 (c)(1),
(2), (4) Date: Jan. 9, 2013

(87) PCT Pub. No.: WO2011/117679

PCT Pub. Date: Sep. 29, 2011

(65) Prior Publication Data

US 2013/0100150 A1 Apr. 25, 2013

(51) Int. Cl.

| | |
|---|---|
| ***G09G 5/10*** | (2006.01) |
| ***G09G 3/20*** | (2006.01) |
| ***G09G 3/34*** | (2006.01) |
| ***G09G 5/00*** | (2006.01) |

(52) U.S. Cl.

CPC ..... *G09G 5/10* (2013.01); *G09G 3/20* (2013.01); *G09G 3/2081* (2013.01); *G09G 3/3406* (2013.01); *G09G 5/001* (2013.01); *G09G 2310/063* (2013.01); *G09G 2320/0261* (2013.01); *G09G 2320/0626* (2013.01); *G09G 2320/10* (2013.01); *G09G 2360/144* (2013.01); *G09G 2360/18* (2013.01)

(58) Field of Classification Search

CPC .... G09G 5/001; G09G 5/10; G09G 2310/063; G09G 2360/144; G09G 2360/18; G09G 3/36

USPC ..... 345/545

See application file for complete search history.

(56) References Cited

U.S. PATENT DOCUMENTS 4,355,334 A * 10/1982 Fitzgibbon ..... H04N 5/58 348/602
4,853,888 A 8/1989 Lata et al. ..... 345/172
5,319,388 A * 6/1994 Mattison ..... G09G 5/001 345/520
5,396,594 A * 3/1995 Griffith ..... G09G 5/026 345/501

(Continued)

FOREIGN PATENT DOCUMENTS

CN 101452681 A 10/2009
EP 1 229 511 A2 8/2002

(Continued)

OTHER PUBLICATIONS

Pan, Hao, et al., "Quantitative Analysis of LCD Motion Blur and Perfoimance of Existing Approaches", © 2005 SID, 4 pgs.

(Continued)

*Primary Examiner* — Jitesh Patel

(74) *Attorney, Agent, or Firm* — Harrington & Smith

(57) ABSTRACT

An apparatus including a controller; a display; a frame memory configured to load a frame of data to the display and configured to be filled by a frame of data from the controller, wherein the controller is configured to control the insertion of blank fields between frames of data displayed on the display in dependence upon a detected context.

21 Claims, 3 Drawing Sheets

(56) References Cited

U.S. PATENT DOCUMENTS 5,404,446 A * 4/1995 Bowater ..... G06F 3/14 345/537
5,982,397 A * 11/1999 Walsh ..... G09G 5/395 345/531
6,091,382 A 7/2000 Shioya et al. ..... 345/76
6,145,033 A * 11/2000 Chee ..... G06F 5/12 710/52
6,509,885 B1 1/2003 Hanaki et al.
6,728,317 B1 * 4/2004 Demos ..... 375/240.21
7,133,015 B1 11/2006 Yoshida et al.
7,298,358 B2 11/2007 Honbo
7,332,742 B2 2/2008 Miyake et al. ..... 257/59
7,836,318 B1 * 11/2010 Alben ..... H03L 7/06 713/300
2001/0008394 A1 7/2001 Kanamori
2002/0003522 A1 * 1/2002 Baba et al. ..... 345/89
2002/0101272 A1 * 8/2002 Bales ..... H03K 19/00315 327/310
2004/0041823 A1 * 3/2004 Shin ..... G09G 3/3233 345/690
2004/0066373 A1 4/2004 Wu ..... 345/168
2004/0160393 A1 8/2004 Kato
2004/0252115 A1 12/2004 Boireau ..... 345/211
2005/0037815 A1 * 2/2005 Besharat ..... G09G 5/02 455/566
2005/0062691 A1 3/2005 Tamura et al.
2005/0068332 A1 * 3/2005 Diefenbaugh et al. ..... 345/604
2005/0134547 A1 * 6/2005 Wyatt ..... G09G 3/3406 345/102
2005/0184952 A1 * 8/2005 Konno ..... G09G 3/3426 345/102
2005/0212824 A1 * 9/2005 Marcinkiewicz .... G09G 3/3406 345/690
2005/0253835 A1 * 11/2005 Kawase ..... 345/207
2005/0259064 A1 11/2005 Sugino et al.
2005/0264549 A1 * 12/2005 Mizumaki ..... G09G 3/3406 345/204
2006/0007218 A1 1/2006 Miyake et al. ..... 345/204
2006/0072042 A1 * 4/2006 Chang ..... G09G 5/006 348/714
2006/0075356 A1 * 4/2006 Faulkner et al. ..... 715/782
2006/0146005 A1 * 7/2006 Baba et al. ..... 345/102
2006/0187242 A1 * 8/2006 Lee ..... G09G 5/10 345/690
2006/0197735 A1 * 9/2006 Vuong ..... G09G 3/3406 345/102
2007/0024772 A1 * 2/2007 Childers ..... G09G 3/3413 349/68
2007/0103408 A1 5/2007 Tada et al. ..... 345/76
2007/0115209 A1 5/2007 Maejima
2007/0120766 A1 5/2007 Yanamoto
2007/0126757 A1 * 6/2007 Itoh et al. ..... 345/690
2007/0146294 A1 * 6/2007 Nurmi ..... G09G 3/3406 345/102
2007/0146384 A1 6/2007 Jo ..... 345/589
2007/0229432 A1 * 10/2007 Kimura ..... 345/96
2007/0229447 A1 * 10/2007 Takahara ..... G09G 3/3406 345/102
2007/0263099 A1 * 11/2007 Motta et al. ..... 348/222.1
2007/0279369 A1 * 12/2007 Yao et al. ..... 345/102
2007/0285382 A1 * 12/2007 Feng ..... 345/102
2008/0018571 A1 * 1/2008 Feng ..... G09G 3/3648 345/87
2008/0068293 A1 * 3/2008 Ishii ..... G09G 3/20 345/3.1
2008/0068312 A1 3/2008 Kim ..... 345/84
2008/0068359 A1 3/2008 Yoshida et al.
2008/0074592 A1 * 3/2008 Araki et al. ..... 349/114
2008/0180453 A1 * 7/2008 Fergason et al. ..... 345/581
2008/0186261 A1 8/2008 Lee ..... 345/82
2008/0198120 A1 8/2008 Senda et al. ..... 345/92
2008/0231579 A1 * 9/2008 Vasquez et al. ..... 345/98
2008/0239179 A1 10/2008 Kasai ..... 349/34
2008/0284719 A1 * 11/2008 Yoshida ..... 345/102
2008/0303808 A1 12/2008 Huang
2009/0033686 A1 2/2009 Asano ..... 345/690
2009/0046104 A1 * 2/2009 Boiko ..... 345/545
2009/0109247 A1 * 4/2009 Kimura ..... 345/690
2009/0127461 A1 * 5/2009 Holcombe ..... H04B 10/116 250/338.1
2009/0135304 A1 5/2009 Inoue et al.
2009/0140964 A1 6/2009 Chiang
2009/0184904 A1 * 7/2009 S. ..... G09G 3/3413 345/82
2009/0201383 A1 * 8/2009 Slavin ..... 348/222.1
2009/0231354 A1 * 9/2009 Blaut et al. ..... 345/589
2009/0243995 A1 * 10/2009 Kimura ..... 345/102
2009/0295706 A1 * 12/2009 Feng ..... 345/102
2009/0327777 A1 * 12/2009 Vasquez et al. ..... 713/320
2010/0013750 A1 * 1/2010 Kerofsky et al. ..... 345/89
2010/0013995 A1 1/2010 Um ..... 348/500
2010/0066714 A1 3/2010 Ozaki ..... 345/207
2010/0073276 A1 * 3/2010 Koike ..... G09G 3/3426 345/102
2010/0103089 A1 * 4/2010 Yoshida ..... G09G 3/2022 345/102
2010/0123416 A1 * 5/2010 Lin et al. ..... 315/313
2010/0156865 A1 * 6/2010 Kreek ..... G06F 1/1626 345/207
2010/0277409 A1 11/2010 Yamamoto ..... 345/102
2010/0315408 A1 * 12/2010 Kang et al. ..... 345/214
2011/0074690 A1 * 3/2011 Broga et al. ..... 345/169
2011/0135317 A1 * 6/2011 Chaplin ..... 398/172
2011/0169848 A1 * 7/2011 Bratt ..... G09G 5/363 345/545
2012/0327142 A1 12/2012 Kimura

FOREIGN PATENT DOCUMENTS

EP 1589518 A2 10/2005
EP 1 903 545 A2 3/2008
EP 2061020 A2 5/2009
EP 2141685 A2 1/2010
GB 2 455 846 A 6/2009
JP 2005164937 6/2005
KR 20070119198 12/2007
KR 20080015598 2/2008
WO 2006123706 A1 11/2006
WO 2009125600 A1 10/2009
WO 2009145329 A1 12/2009

OTHER PUBLICATIONS

Kurita, Taiichiro, "Moving Picture Quality Improvement for Hold-type AM-LCDs", © 2001 SID, 4 pgs.
Su, Ting-Wei, et al., "LCD Visual Quality Analysis by Moving Picture Simulation", © 2005 SID, 4 pgs.
C.F. Chaplin; "Method of Controlling Brightness of Light Source Used for Data Transmission"; U.S. Appl. No. 61/266,482, filed Dec. 3, 2009 (4 pages), not published.
P.Y. Ngai; "The Relationship Between Luminance Uniformity and Brightness Perception"; Journal of the Illuminating Engineering Society; Winter 2000; pp. 41-50.
J. Amanatides et al.; "Antialiasing of Interlaced Video Animation"; Computer Graphics, vol. 24, No. 4; Aug. 1990; pp. 77-85.

* cited by examiner

APPARATUS, DISPLAY MODULE AND METHOD FOR ADAPTIVE BLANK FRAME INSERTION

FIELD OF THE INVENTION

Embodiments of the present invention relate to an apparatus, a display module, or a method, for example.

BACKGROUND TO THE INVENTION

High contrast high resolution displays are now available for hand-portable electronic devices. These displays can display stationary images exceptionally well. However, if the images move they may appear blurred to a human user.

BRIEF DESCRIPTION OF VARIOUS EMBODIMENTS OF THE INVENTION

According to various, but not necessarily all, embodiments of the invention there is provided an apparatus comprising: a controller; a display; a frame memory configured to load a frame of data to the display and configured to be filled by a frame of data from the controller, wherein the controller is configured to control the insertion of blank fields with respect to frames of data displayed on the display in dependence upon a detected context.

According to various, but not necessarily all, embodiments of the invention there is provided a module comprising: a controller; a display; a detector; a frame memory configured to load a frame of data to the display and configured to be filled by a frame of data from the controller, wherein the controller is configured to control the insertion of blank fields with respect to frames of data displayed on the display in dependence upon a context detected by the detector.

According to various, but not necessarily all, embodiments of the invention there is provided a method comprising: displaying a frame of data in a display; displaying a blank field on the display for a duration dependent upon a detected context; and displaying a next frame of data in the display.

Mobile apparatus in particular are used in different often rapidly changing contexts. For example, a user may walk from outside on a sunny day to a shady room inside. A display that has sufficient luminance for outside use in bright conditions will be too bright for shady conditions. Some but not necessarily all embodiments of the present invention solve this problem by inserting blank fields with respect to frames of data displayed on a display in dependence upon a detected context.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
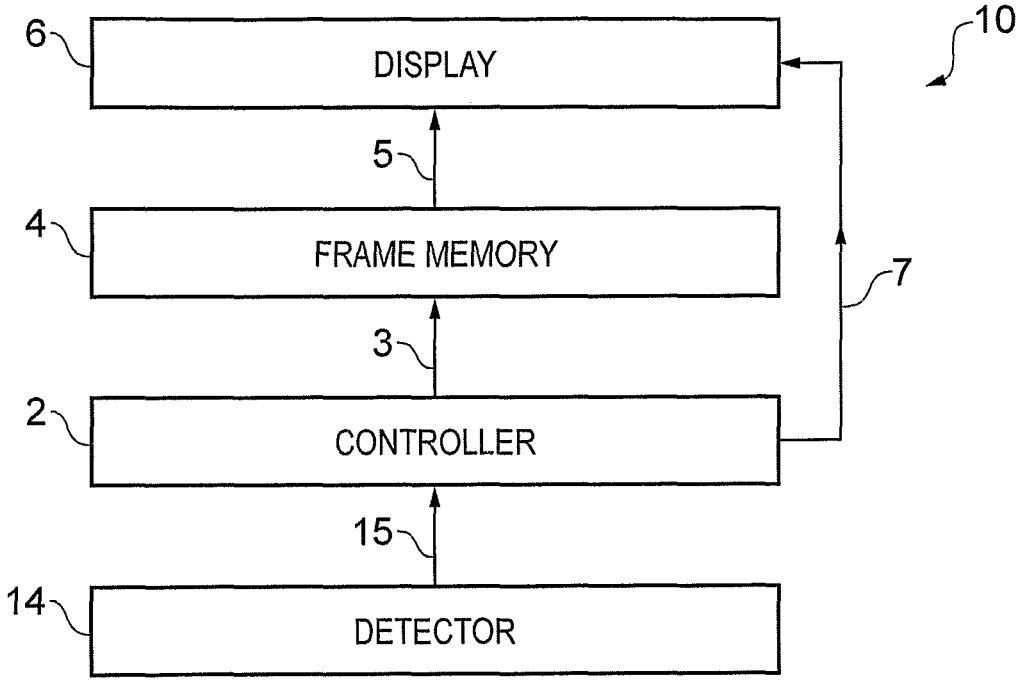
FIG. 1 schematically illustrates an apparatus including a display.

In the following description the transfer of data to a frame memory will be described and the transfer of data from a frame memory will be described. For clarity of description, the term 'fill' will be used to denote transfer of data to a frame memory and the term 'load' will be used to denote transfer of data from a frame memory. No other special technical meaning is intended merely by the use of different terms to denote the transfer of data.

The Figures schematically illustrates an apparatus 10 comprising: a controller 2; a display 6; a frame memory 4 configured to load a frame of data 5 to the display 6 and configured to be filled by a frame of data 3 from the controller 2, wherein the controller 2 is configured to control the insertion of blank fields 11 with respect to frames of data 5 displayed on the display 6 in dependence upon a detected context 15.

The apparatus 10, in the example illustrated, comprises a detector 14 for detecting the context 15. However, in other embodiments the apparatus 10 may not comprise a detector 14.

Figure 2:
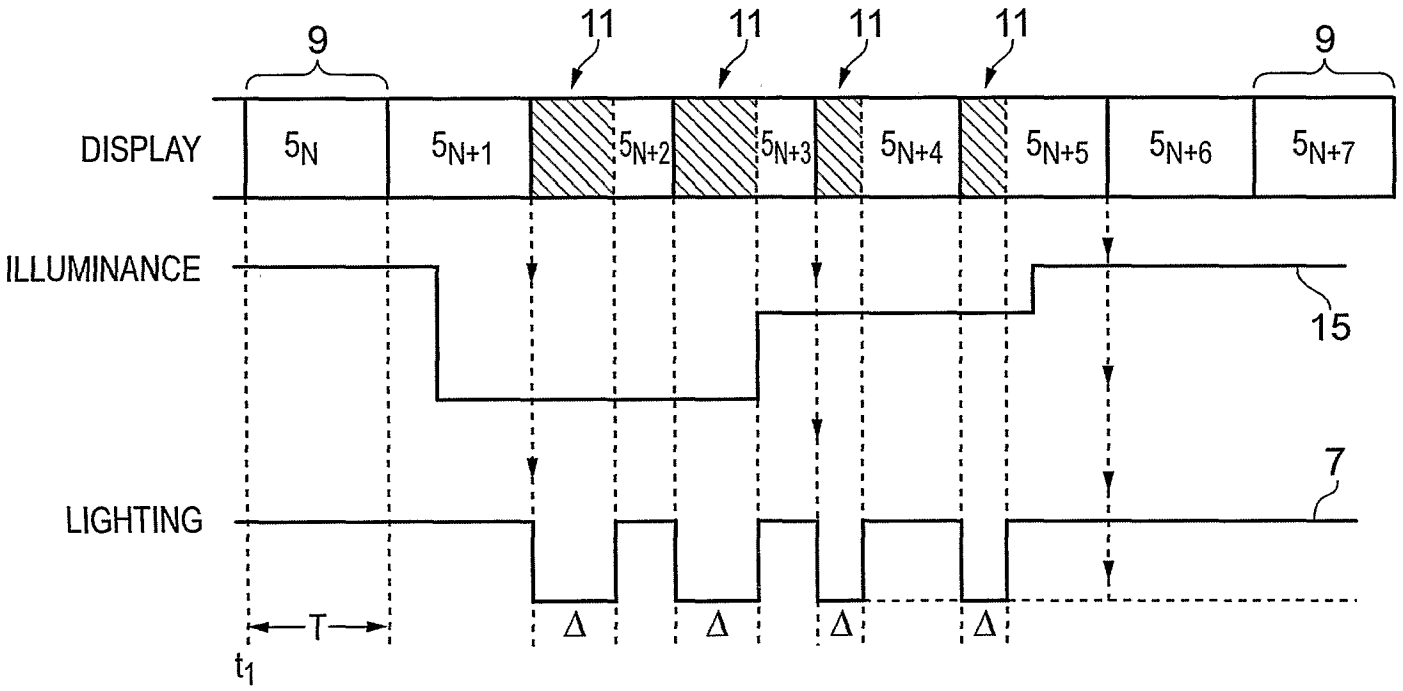
FIG. 2 schematically illustrates a timing diagram for the apparatus of FIG. 1.

Referring to FIGS. 1 and 2, the controller 2 has an interface to the frame memory 4 over which successive frames of data 3 are sent to fill the frame memory 4. In the illustrated example, the frames of data 3 are sent periodically every time period T. The frames of data 3 may be sent asynchronously and without flow control.

The frame memory 4 has an interface to the display 6 over which the successive frames of data 5 stored in the frame memory 4 are loaded to the display 6 and are displayed as display frames 9 with a periodicity of T. The frame of data 5 loaded to the display 6 may be the same as the frame of data 3 previously sent by the controller 2 to fill the frame memory 4.

The frame memory 4 may operate as a first-in-first-out register. It may only have storage capacity for one frame of data. Alternatively it may have storage capacity for more than one frame of data.

The controller 2 is configured to insert blank fields (images) 11 within the display frames 9 using control signal 7.

The blank fields may in some embodiments be blank (sub) frames 11 within the display frame 9 and between (sub) frames of data 5. A display frame 9 of duration T can therefore be shared between a blank (sub) frame 11 of duration Δ and a (sub) frame of data 5 of duration T−Δ. The blank fields 11 in this example last Δ and start at time t1+mT where m is an integer and where Δ is a parameter controlled by the controller 2 in dependence upon a detected context 15. In this example, the display frame 9 is time divided between the wholly blank (sub) frame 11 and the data (sub) frame 5.

In other embodiments, the blank field 11 and the data frame 5 co-exist with the blank field overlying a portion of the display frame 9 with the other portion of the display frame 9 being occupied by data frame(s). The blank field 11 progressively scans across the display frame 9 as display refresh (scanning) proceeds. The blank field may be positioned at the interface between the tail end of a leading frame of data and a leading end of a following frame of data. As the following frame of data progresses across the display towards an edge of the display, the blank field 11 in advance of it reduces in size and another blank field following it increases in size.

A blank field 11 may be a field that contains no data so that the frame or frame portion appears black or contains adapted data such that the frame or frame portion appears a different monotone color or appears dimmed, for example.

The display 6 may, in some embodiments be a high output luminance display. The display 6 may be, for example, an active matrix (AM) organic light emitting diode (OLED) display or a thin film transistor (TFT) liquid crystal display (LCD). The display 6 may have high contrast and high resolution.

The display 6 may operate with a display frame rate of 60 Hz or 75 Hz, for example. This is three times the Phase Alternate Line (PAL) rate, 2.5 times the National Television System Committee (NTSC) rate and approximately three times a film frame rate.

The detected context 15 may, in one example embodiment be that the content represented by successive data frames 5 loaded into the display 6 comprises a fast moving image. The fast moving image may, for example, result from the display of video or as a consequence of a user scrolling or moving content on the display 6. In this embodiment, the detector 14 may detect the content type represented by the data frames 5. The detector 14 may be integrated as a part of the controller 2 or display 6. Variation in luminance arising from insertion of blank fields 11 may be compensated for by controlling the intensity of the pixels of the display 6 or by calculating a modified data frame 5 to be uploaded into the display 6.

The following description describes the use of blank (sub) frames 11, however, it should be appreciated that its teaching has a more general application relating to the insertion of blank fields 11 in general including the insertion of blank fields 11 that overlie a portion of the data frame 5 in the display frame 9.

The controller 2 is configured to start inserting blank fields 11 between frames of data 5 displayed on the display 6 in dependence upon detecting a predetermined change in context. The change in context may be the detection of a representation of a fast moving image in the frames of data 5 or the detection of a mode in which the likelihood of a representation of fast moving image in the frames of data 5 occurring is high.

The detected context 15 may, alternatively or additionally, be an external or environmental or ambient context that is dependent upon the surrounding, external environment to the apparatus 10 at that time. For example, the content 15 may be ambient light conditions such as ambient illuminance. In this example, the detector 14 may be an ambient light sensor that detects the intensity of light falling on the apparatus 10. In some implementations, the ambient light sensor 14 may be integrated as part of the display 6.

The controller 2 is configured to start inserting blank fields 11 between frames of data 5 displayed on the display 6 in dependence upon detecting a predetermined change in context 15 such as a decrease in the detected illuminance below a threshold. In this low illuminance context, the luminance of the display 6 may be too high and the insertion of blank fields 11 reduces the effective brightness to an acceptable level.

In high illuminance environment such as outdoors, display luminance may be at 100% level to make the display readable. This level of luminance may be too bright in lower illuminance environments such as indoors, and the display luminance can be decreased to an optimal viewing level. When inserting blank fields 11 within display frames 9, the display 6 has a much improved perceived moving image quality and the display 6 consumes less power.

The controller 2 is configured to control the effective brightness by changing the duration of the blank fields 11 inserted between the frames of data 5. As the detected illuminance 15 decreases the duration of the blank fields 11 increases producing lower display luminance and reducing power consumption. As the detected illuminance 15 increases the duration of the blank fields 11 decreases.

The controller 2 is configured to dynamically change the duration of the inserted blank fields 11. The change may be in real-time and dependent upon a dynamic change in the detected illuminance 15. However, typically changes do not happen instantaneously or rapidly, but have some time constant for a smooth and pleasant change. For convenience, in FIG. 2, changes appear instantly as this illustrates the control mechanism better.

Figure 3:
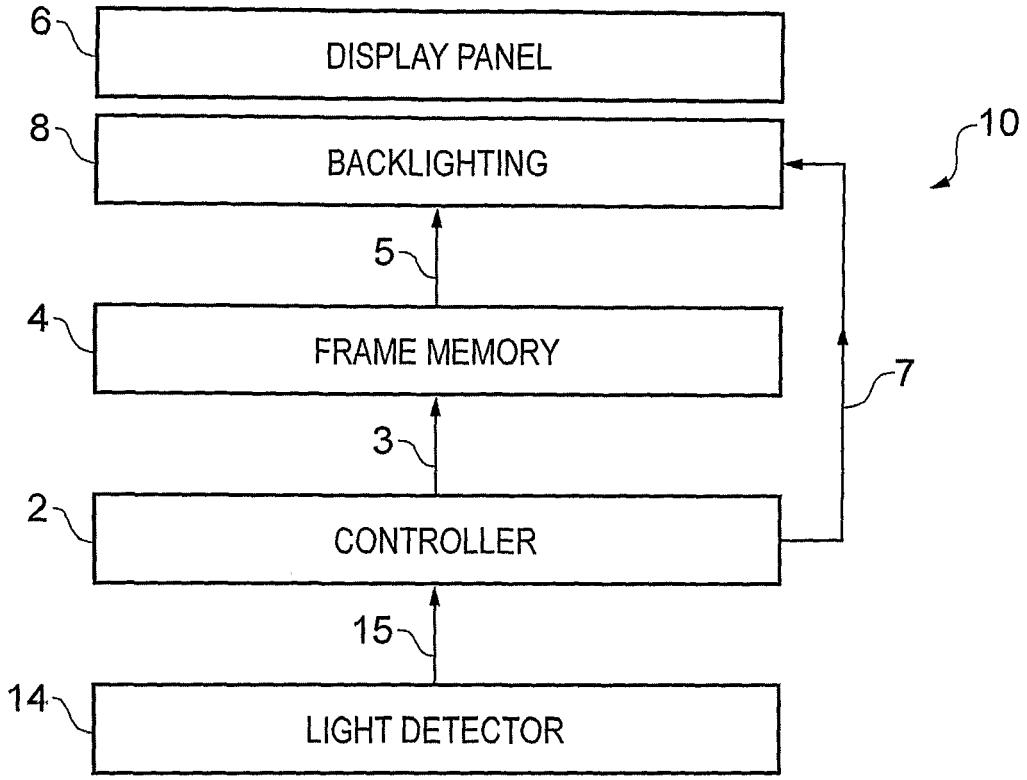
FIG. 3 schematically illustrates the apparatus with backlighting.

FIG. 3 schematically illustrates an example of how, in one example embodiment, the controller 2 may be configured to insert a blank field 11. The controller 2 uses a control signal 7 to control lighting for a display 6. In this illustrated example, the control signal 7 switches the lighting 8 on and off, but in other implementations it may dim the lighting instead of turning it off. Dimming would, however, typically involve a step-change in luminance. The blank field 11 is therefore a black or dark frame in which any data loaded into the display 6 is not visible.

In some cases the display frame can be formed from two successive images, one brighter another darker to make the overall image look correct without losses in screen luminance. The control of the lighting of the display may be achieved by controlling a backlight 8, if present, or, if a backlight is not present, by adapting the frame data 5. If a backlight is present, it may be an integral part of the display 6.

In this example, the control signal 7 switches the backlighting 8 on and off. The controller 2 is configured to control insertion of blank frames between frames of data 5 displayed on the display 6 by temporarily switching off the backlighting for the duration of the blank frame 11. A suitable control signal 7 is illustrated in FIG. 2. The example control signal 7 in FIG. 2, has a programmable duty cycle in which the backlighting 8 is off for $\Delta$ between time $t1+mT$ and $t1+\Delta+mT$ and in which the backlighting 8 is on for $T-\Delta$ between time $t1+\Delta+mT$ and $t1+T+mT$, where m is an integer. In the illustrated example, t1 coincides with the beginning of a display frame 9 but t1 need not necessarily coincide with the beginning of a display frame 9.

The duty cycle may be constrained so that it can only have one or more values below 100% such as between 100% and 10%, where 100% represents no blank frame insertion.

The duty cycle can be controlled in dependence upon ambient light conditions. As the illuminance 15 decreases the duty decreases, inserting blank frames 11 of longer duration $\Delta$.

The apparatus 10 may be an electronic apparatus or a module for an electronic apparatus. The apparatus 10 may, for example, be a hand portable apparatus or portable electronic device. It may, for example, be a mobile cellular telephone or a personal music, video or computing device or a digital camera.

Portable device may have associated constraints compared to larger device. These may include one or more of: power consumption, touch screen input, low cost requirements, wide environmental operating conditions including ambient illuminance (0 . . . >100 000 lux).

Figure 4:
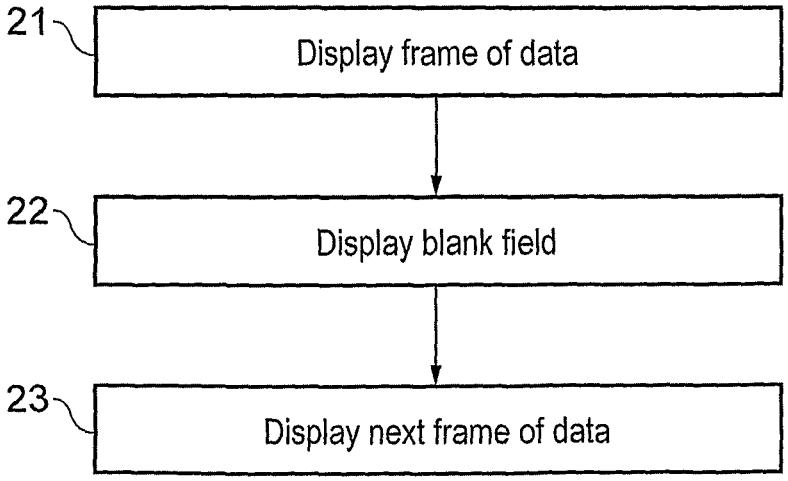
FIG. 4 schematically illustrates a method of operation for a display.

FIG. 4 schematically illustrates a method 20 for controlling a display 6.

At block 21, the display 6 displays a frame of data $5_N$ loaded into the display 6.

At block 22, the display 6 displays a blank field 11 in a manner dependent upon a detected context 15. For example, the display 6 may display a blank frame 11 for a duration dependent upon a detected context 15.

At block 23, the display 6 displays the next frame of data $5_{N+1}$.

At block 22 or 23, the next frame of data 5 may be loaded into the display 6.

At block 22, the blank frame 11 may be displayed by temporarily switching off the backlighting for the duration of the blank frame. The backlighting may be switched on and off with a programmable duty cycle dependent upon the detected context 15, which may be ambient light illumination.

The controller 2 and/or frame memory 4 may be configured to enable the method 20.

Referring back to FIG. 2, the controller performs two purposes. It controls the insertion of blank fields 11 and it provides data to the frame memory. The controller will typically be part of a host apparatus and the frame memory and display 6 will typically be part of a display module 12.

However, the two purposes of the controller may be separated into separate controllers. A data controller would then provide the data and may be part of the host apparatus e.g. a processor and/or a graphics accelerator. A blank field controller would then control the blank field insertion and may be part of the display module 12. In this embodiment, the module comprises: a controller; a display; and a frame memory configured to load a frame of data to the display and configured to be filled by a frame of data from the controller. It may also comprise a detector. The controller is configured to control the insertion of blank fields with respect to frames of data displayed on the display in dependence upon a context detected by the detector.

Implementation of a controller 2 can be in hardware alone (a circuit, a processor . . . ), have certain aspects in software including firmware alone or can be a combination of hardware and software (including firmware).

The controller 2 may be implemented using instructions that enable hardware functionality, for example, by using executable computer program instructions in a general-purpose or special-purpose processor that may be stored on a computer readable storage medium (disk, memory etc) to be executed by such a processor.

The computer program may arrive at the apparatus via any suitable delivery mechanism. The delivery mechanism may be, for example, a computer-readable storage medium, a computer program product, a memory device, a record medium such as a CD-ROM or DVD, an article of manufacture that tangibly embodies the computer program. The delivery mechanism may be a signal configured to reliably transfer the computer program. The apparatus may propagate or transmit the computer program as a computer data signal.

Although the memory is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used here 'module' refers to a unit or apparatus that excludes certain parts/components that would be added by an end manufacturer or a user.

The blocks illustrated in the FIG. 4 may represent steps in a method and/or sections of code in the computer program. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a controller;

a display;

a frame memory configured to load a frame of data to the display for display as a display frame having a display frame duration, and configured to be filled by a frame of data from the controller, the controller having an interface to the frame memory over which successive frames of data are sent asynchronously and without flow control to fill the frame memory; and a backlight for the display, the backlight being controlled by the controller, wherein the controller is configured to control an insertion of a blank field, having a blank field duration, within the display frame in dependence upon a detected predetermined change in context, the blank field duration being a portion of the display frame duration, and the predetermined change in context being one or more of a decrease in a detected ambient illuminance below a threshold, a fast-moving image on the display, and fast scrolling of an image by a user, temporarily switching off or dimming the backlight for the blank field duration and switching on the backlight for the remainder of the display frame duration in order to reduce a level of luminance of the display to provide an optimal viewing level of luminance of the display, the blank field thereby being a black or dark frame wherein any data loaded into the display is not visible, and wherein the controller is configured to control the insertion of the blank field, within the display frame, such that the blank field is displayed before the frame of data.

2. The apparatus as claimed in claim 1, wherein the controller is configured to change the blank field duration in dependence upon detecting the predetermined change in context.

3. The apparatus as claimed in claim 1, wherein the controller is configured to switch the backlight on and off with a programmable duty cycle.

4. The apparatus as claimed in claim 3, wherein the duty cycle is dynamically controllable to give the blank field duration a value between 100% and 10% of the display frame duration.

5. The apparatus as claimed in claim 3, wherein the duty cycle is dependent upon ambient light conditions.

6. The apparatus as claimed in claim 3, wherein the duty cycle is dependent upon detected illuminance.

7. The apparatus as claimed in claim 1, further comprising a detector for detecting the context.

8. The apparatus as claimed in claim 7, wherein the detector is an ambient light sensor.

9. The apparatus as claimed in claim 1, wherein the display is a high luminance display.

10. The apparatus as claimed in claim 8, wherein the frame memory is configured to load frames of data to the display at a frame rate that is dependent upon ambient light conditions.

11. The apparatus as claimed in claim 1, wherein the controller is configured to control the insertion of blank fields between frames of data displayed on the display in dependence upon a detected context.

12. The apparatus as claimed in claim 1, wherein the controller is configured to control the scanning of blank sub-frames across the display in dependence upon a detected context.

13. The apparatus as claimed in claim 1, wherein the apparatus is a portable electronic device.

14. A module comprising the apparatus of claim 1.

15. The apparatus according to claim 1, wherein the controller is configured to control the intensity of pixels of the display, or to calculate a modified data frame to be uploaded to the display, to compensate for variation in luminance of the display arising from insertion of a blank field.

16. The apparatus as claimed in claim 1, wherein the frame memory has storage capacity for one frame of data.

17. The apparatus as claimed in claim 1, wherein the controller is configured to dynamically change the duration of the inserted blank fields in real-time dependence upon detecting a dynamic change in context, and the dynamic change in context is a change in detected ambient illuminance.

18. A method comprising:

filling a frame memory with a frame of data from a controller, wherein the controller has an interface to the frame memory over which successive frames of data are sent asynchronously and without flow control to fill the frame memory;

loading, from the frame memory, the frame of data to a display, for display as a display frame having a display frame duration;

controlling, via the controller, an insertion of a blank field, having a blank field duration, the blank field duration being a portion of the display frame duration, within the display frame in dependence upon a detected predetermined change in context, wherein the predetermined change in context is one or more of a decrease in a detected ambient illuminance below a threshold, a fast-moving image on the display, and fast scrolling of an image by a user;

controlling, via the controller, backlighting for the display, wherein the controller is configured to control the insertion of the blank field within the display frame by, during the display frame duration, temporarily switching off or dimming the backlighting for the blank field duration and switching on the lighting for the remainder of the display frame duration in order to reduce a level of luminance of the display to provide an optimal viewing level of luminance of the display, the blank field thereby being a black or dark frame wherein any data loaded into the display is not visible, and wherein the controller is configured to control the insertion of the blank field, within the display frame, such that the blank field is displayed before the frame of data.

19. The method as claimed in claim 18, wherein the backlighting is switched with a programmable duty cycle dependent upon the detected context.

20. The method according to claim 18, further comprising controlling the intensity of pixels of the display, or calculating a modified data frame to be uploaded to the display, to compensate for variation in luminance of the display arising from insertion of a blank field.

21. A non-transitory computer readable medium comprising program instructions for causing an apparatus to perform:

filling a frame memory with a frame of data from a controller, wherein the controller has an interface to the frame memory over which successive frames of data are sent asynchronously and without flow control to fill the frame memory;

loading, from the frame memory, the frame of data to a display, for display as a display frame having a display frame duration;

controlling, via the controller, an insertion of a blank field, having a blank field duration, the blank field duration being a portion of the display frame duration, within the display frame in dependence upon a detected predetermined change in context, wherein the predetermined change in context is one or more of a decrease in a detected ambient illuminance below a threshold, a fast-moving image on the display, and fast scrolling of an image by a user;

controlling, via the controller, backlighting for the display, wherein the controller is configured to control the insertion of the blank field within the display frame by, during the display frame duration, temporarily switching off or dimming the backlighting for the blank field duration and switching on the lighting for the remainder of the display frame duration in order to reduce a level of luminance of the display to provide an optimal viewing level of luminance of the display, the blank field thereby being a black or dark frame wherein any data loaded into the display is not visible, and wherein the controller is configured to control the insertion of the blank field, within the display frame, such that the blank field is displayed before the frame of data.

* * * * *